US012157935B2

(12) United States Patent
Hu

(10) Patent No.: US 12,157,935 B2
(45) Date of Patent: Dec. 3, 2024

(54) POWDER METAL COMPOSITION FOR EASY MACHINING

(71) Applicant: Hoganas AB (Publ), Hoganas (SE)

(72) Inventor: Bo Hu, Greensburg, PA (US)

(73) Assignee: HOGANAS AB (PUBL), Höganäs (SE)

( * ) Notice: Subject to any disclaimer, the term of this patent is extended or adjusted under 35 U.S.C. 154(b) by 666 days.

(21) Appl. No.: 16/082,452

(22) PCT Filed: Mar. 13, 2017

(86) PCT No.: PCT/EP2017/055810
§ 371 (c)(1),
(2) Date: Sep. 5, 2018

(87) PCT Pub. No.: WO2017/157835
PCT Pub. Date: Sep. 21, 2017

(65) Prior Publication Data

US 2019/0084039 A1 Mar. 21, 2019

(30) Foreign Application Priority Data

Mar. 18, 2016 (EP) ..... 16161116

(51) Int. Cl.

| | |
|---|---|
| ***C22C 33/02*** | (2006.01) |
| ***B22F 1/10*** | (2022.01) |
| ***B22F 1/105*** | (2022.01) |
| ***B22F 1/12*** | (2022.01) |
| ***B22F 3/16*** | (2006.01) |
| ***B22F 3/24*** | (2006.01) |

(52) U.S. Cl.
CPC ..... *C22C 33/0264* (2013.01); *B22F 1/10* (2022.01); *B22F 1/105* (2022.01); *B22F 1/12* (2022.01); *B22F 3/162* (2013.01); *B22F 2003/248* (2013.01); *B22F 2301/35* (2013.01); *B22F 2998/10* (2013.01)

(58) Field of Classification Search
None
See application file for complete search history.

(56) References Cited

U.S. PATENT DOCUMENTS

| | | | | |
|---|---|---|---|---|
| 4,274,875 | A | 6/1981 | Cadle et al. | |
| 4,927,461 | A | 5/1990 | Ciloglu et al. | |
| 5,631,431 | A | 5/1997 | Andersson | |
| 5,938,814 | A | 8/1999 | Uenosono et al. | |
| 6,012,703 | A | 1/2000 | Hayashi et al. | |
| 7,300,490 | B2 | 11/2007 | Ozaki et al. | |
| 2002/0037400 | A1 | 3/2002 | Fujiwara et al. | |
| 2010/0116088 | A1 | 5/2010 | Sato et al. | |
| 2011/0262294 | A1* | 10/2011 | Andersson | B22F 1/007 419/10 |
| 2016/0151837 | A1* | 6/2016 | Nushiro | B22F 3/16 419/38 |

FOREIGN PATENT DOCUMENTS

| | | | | |
|---|---|---|---|---|
| AU | 655514 | B2 | 12/1994 | |
| CN | 104321839 | A | 1/2015 | |
| EP | 0183666 | A1 | 6/1986 | |
| EP | 0589088 | A1 | 3/1994 | |
| EP | 1002883 | A1 | 5/2000 | |
| EP | 1985393 | A1 | 10/2008 | |
| EP | 2537805 | A1 | 12/2012 | |
| JP | H01255604 | A | 10/1989 | |
| JP | H09279204 | A | 10/1997 | |
| JP | H 10-081943 | A | 3/1998 | |
| JP | H2010317002 | A | 12/1998 | |
| JP | 2001-347602 | A | 12/2001 | |
| JP | 2009-035796 | A | 2/2009 | |
| JP | 2010-111937 | A | 5/2010 | |
| JP | 2012-513538 | A | 6/2012 | |
| JP | 2013-519625 | A | 5/2013 | |
| WO | 2005102567 | A1 | 11/2005 | |
| WO | 2010074627 | A1 | 7/2010 | |
| WO | 2013124001 | A1 | 8/2013 | |
| WO | WO-2013159558 | A1 * | 10/2013 | B22F 3/14 |

OTHER PUBLICATIONS

International Search Report and Written Opinion issued in International Patent Application No. PCT/EP2017/055810, 10 pages (Jun. 8, 2017).
Office Action (Communication pursuant to Article 94(3) EPC) issued on Nov. 21, 2019, by the European Patent Office in corresponding European Application No. 17 710 724.0-1103. (5 pages).
Office Action (Notice of Reasons for Refusal) issued on Feb. 16, 2021, by the Japanese Patent Office in corresponding Japanese Patent Application No. 2018-548750, and an English Translation of the Office Action. (28 pages).
Office Action issued on Jul. 8, 2021, by the Federal Public Service Ministry of Economy National Institute of Industrial Property in Brazilian Patent Application No. BR112018068351-5 and an English Translation of the Office Action. (9 pages).
Office Action (Communication pursuant to Article 94(3) EPC) issued on Sep. 9, 2021, by the European Patent Office in corresponding European Application No. 17 710 724.0-1103, (4 pages).
Daou, I. et al. "Probing the Dehydroxylation of Kaolinite and Halloysite by In Situ High Temperature X-ray Diffraction", Minerals, vol. 10, No. 5, May 25, 2020, p. 480, XP055837699.
Office Action issued on Jun. 15, 2021, by the Chinese Patent Office in corresponding Chinese Patent Application No. 201780017879.2, and an English Translation of the Office Action. (13 pages).

(Continued)

*Primary Examiner* — Adil A. Siddiqui
(74) *Attorney, Agent, or Firm* — Boone IP Law

(57) ABSTRACT

The present invention concerns an iron-based powder composition comprising, in addition to an iron-based powder, a minor amount of a machinability enhancing additive, said additive comprising at least halloysite. The invention further concerns the use of the machinability enhancing additive and a method for producing an iron-based sintered component for easy machining.

19 Claims, No Drawings

(56) References Cited

OTHER PUBLICATIONS

Office Action issued on Jun. 29, 2021, by the Taiwan Intellectual Property Office in corresponding Taiwanese Patent Application No. 106108742, and an English Translation of the Office Action. (11 pages).
Office Action (Notice of Final Rejection) issued on Jun. 25, 2021, by the Korean Patent Office in corresponding Korean Patent Application No. 10-2018-7028925, and an English Translation of the Office Action. (9 pages).
Office Action issued on Apr. 15, 2022, by the Brazilian Patent Office in Brazilian Patent Application No. BR112018068351-5, English Translation only. (4 pages).

* cited by examiner

POWDER METAL COMPOSITION FOR EASY MACHINING

TECHNICAL FIELD OF THE INVENTION

The invention refers to a powder metal composition for production of powder metal parts, as well as a method for producing powder metal parts, having improved machinability.

BACKGROUND OF THE INVENTION

One of the major advantages of powder-metallurgical manufacture is that it becomes possible, by compacting and sintering, to produce components in final or very close to final shape. There are however instances where subsequent machining is required. For example, this may be necessary because of high tolerance demands or because the final component has such a shape that it cannot be pressed directly. More specifically, geometries such as holes transverse to the compacting direction, undercuts and threads, call for subsequent machining.

By continuously developing new sintered steels with higher strength and higher hardness, machining has become a challenge in powder-metallurgical manufacture of components. It is often a limiting factor when assessing whether powder-metallurgical manufacture is the most cost-effective method for manufacturing a component.

Today, there are a number of known substances which are added to iron-based powder mixtures to facilitate the machining of components after sintering. The most common powder additive is MnS (manganese sulfide), which is mentioned e.g. in EP 0 183 666, describing how the machinability of a sintered steel is improved by the admixture of such powder.

U.S. Pat. No. 4,927,461 describes the addition of 0.01% and 0.5% by weight of hexagonal BN (boron nitride) to iron-based powder mixtures to improve machinability after sintering.

U.S. Pat. No. 5,631,431 relates to an additive for improving the machinability of iron-based powder compositions. According to this patent the additive contains calcium fluoride particles which are included in an amount of 0.1%-0.6% by weight of the powder composition.

The Japanese patent application 08-095649 describes a machinability enhancing agent. The agent comprises $Al_2O_3$—$SiO_2$—CaO and has an anorthite or a gehlenite crystal structure. Anorthite is a tectosilicate, belonging to the feldspar group, having Mohs hardness of 6 to 6.5 and gehlenite is a sorosilicate having Mohs hardness of 5-6.

U.S. Pat. No. 7,300,490 describes a powder mixture for producing pressed and sintered parts consisting of a combination of manganese sulfide powder (MnS) and calcium phosphate powder or hydroxy apatite powder.

WO publication 2005/102567 discloses a combination of hexagonal boron nitride and calcium fluoride powders used as machining enhancing agent.

Boron containing powders such as boron oxide, boric acid or ammonium borate, in combination with sulphur is described in U.S. Pat. No. 5,938,814.

Other combinations of powders to be used as machining additives are described in EP 1985393A1, the combination containing at least one selected from talc and steatite and a fatty acid.

Talc as machining enhancing agent is mentioned in JP1-255604.

The application EP1002883 describes powdered metal blends for making metal parts, especially valve seat inserts. The blends described contain 0.5-5% of solid lubricants in order to provide low friction and prevent sliding wear as well as provide improvement in machinability. In one of the embodiments, mica is mentioned as a solid lubricant. These types of powder mixtures, used for production of wear resistant and high temperature stable components, always contain high amounts of alloying elements, typically above 10% by weight and hard phases, typically carbides.

U.S. Pat. No. 4,274,875 teaches a process for the production of articles, similar to what is described in EP1002883, by powder metallurgy, including the step of adding powdered mica to the metal powder before compaction and sintering in amounts between 0.5% to 2% by weight. Specifically, it is disclosed that any type of mica can be used.

Further, the Japanese patent application JP10317002, describes a powder and a sintered compact having a reduced friction coefficient. The powder has a chemical composition of 1-10% by weight of sulphur, 3-25% by weight of molybdenum and the balance iron. Further a solid lubricant and hard phase materials are added.

WO2010/074627 discloses an iron-based powder composition comprising, in addition to an iron-based powder, a minor amount of a machinability enhancing additive, said additive comprising at least one silicate from the group of phyllosilicates. Specific examples of the additive are muscovite, bentonite and kaolinite.

Machining of pressed and sintered components is very complex and is influenced by parameters such as type of alloying system of the component, the amount of alloying elements, sintering conditions such as temperature, atmosphere and cooling rate, sintered density of the component, size and shape of the component. It is also obviously affected by the type of machining operation and machining parameters which have a great importance to the outcome of the machining operation. The diversity of proposed machining enhancing agents to be added to powder metallurgical compositions reflects the complex nature of the PM machining technology.

SUMMARY OF THE INVENTION

The terms "contains" and "containing" in this context means that other substances or species may be present other than those explicitly mentioned.

The terms "consists" or "consisting of" in this context means that no other substances or species are present than those explicitly mentioned.

The present invention discloses a new additive for improving the machinability of sintered steels. Specifically, the additive facilitates machining operations such as drilling of sintered steels, in particular drilling of sintered components containing iron, copper and carbon such as connecting rods, main bearing caps and variable valve timing (VVT) components. Other machining operations, such as turning, milling and threading are also facilitated by the new machinability enhancing additive. Further, the new additive can be used in components to be machined by several types of tool materials such as high speed steel, tungsten carbides, cermets, ceramics and cubic boron nitride and the tool may also be coated.

An object of the present invention is thus to provide a new additive for a powder metal composition for improvement of machinability.

Another object of the present invention is to provide such additive to be used at various machining operations for different types of sintered steels.

Another object of the present invention is to provide a new machinability enhancing additive having no or negligible impact on the mechanical properties of the pressed and sintered component.

A further object of the invention is to provide a powder metallurgical composition containing the new machinability enhancing additive, as well as a method of preparing a compacted part from this composition.

Another object of the invention is to provide a sintered component having improved machinability, in particular sintered component containing iron-copper-carbon. However, the invention is not limited to the iron-copper carbon system. Components made form sintered stainless steel powders, diffusion bonded powders, low alloy powders having various kinds of alloying elements such as Mo, Ni, Cu, Cr, Mn, Si, etc., may also benefit from the new machinability enhancing additive.

It has now been found that by including a machinability enhancing additive containing a defined halloysite compound in powder form to the iron-based powder composition, a surprisingly great improvement in machinability of sintered components, made from the iron-based powder composition, is achieved. Furthermore, the positive effect on machinability is obtained even at very low added amounts, thus, it is anticipated that a negative impact on the compressibility by adding additional non-metallic substances is minimized.

According to the present invention, at least one of the above objects, as well as other objects evident from the below discussion, is achieved by the different aspects of the present invention.

According to a first aspect of the present invention, there is a new machinability enhancing additive containing halloysite for facilitating machining of components of sintered steels.

According to a second aspect of the present invention, there is an iron-based powder composition comprising an iron-based powder, a small amount of a machinability enhancing additive in powder form, said additive containing halloysite.

According to a third aspect of the present invention, there is a use of halloysite in powder form comprised in a machinability improving additive in an iron-based powder composition.

According to a fourth aspect of the present invention, there is a method of preparing an iron-based powder composition, comprising: providing an iron-based powder; and admixing the iron-based powder mixture with a machinability enhancing additive in powder form, the machinability enhancing additive containing halloysite.

According to a fifth aspect of the present invention, there is a method for producing an iron-based sintered component having improved machinability, comprising; preparing an iron-based powder composition according to the above aspect; compacting the iron-based powder composition at a compaction pressure of 400-1200 MPa; sintering the compacted part at a temperature of 700-1350° C.; and optionally heat treating the sintered component.

According to a sixth aspect of the present invention, there is a sintered component containing the new machinability enhancing additive. In one embodiment the sintered component contains iron, copper and carbon. In another embodiment the sintered component is chosen from the group of connecting rods, main bearing caps and variable valve timing (VVT) components.

DETAILED DESCRIPTION OF THE INVENTION

Halloysite is a natural-occurred silicate mineral and has a similar composition to kaolinite except that it contains additional water molecules between the layers and most commonly has a tubular morphology compared to platy forms typically observed in kaolinite. As a result, hydrated halloysite has a larger basal spacing than that of kaolinite. In its fully hydrated form the formula is $Al_2Si_2O_5(OH)_4$—$2H_2O$. When halloysite loses its interlayer water it is often observed in a partly dehydrated state. In this case, the halloysite can be identified or distinguish from kaolinite by ethylene glycol solvation following by X-ray powder diffraction (XRPD) analysis. The two minerals appear to form independently because no transition phases (between halloysite and kaolinite) are found as ageing progresses. Also, halloysite is a fast-forming metastable precursor to kaolinite so that the size of halloysite grain particles are smaller to that of kaolinite and the specific surface area (SSA) of halloysites is usually greater than those of kaolinite.

Machinability Enhancing Additive (First Aspect)

The machinability enhancing additive according to the invention contains halloysite having a specific surface area (SSA, measured with the BET method) of at least 15 $m^2/g$, preferably at least 20 $m^2/g$, and more preferably at least 25 $m^2/g$ and may also include or be mixed with other known machining enhancing substances such as manganese sulfide, hexagonal boron nitride, other boron containing substances, calcium fluoride, mica such as muscovite, talc, enstatite, bentonite, kaolinite, titanate, anorthite, gelehnite, calcium sulphide, calcium sulphate etc. Preferred substances are manganese sulfide, hexagonal boron nitride, calcium fluoride, mica such as muscovite, bentonite, kaolinite, titanate. When the machinability enhancing additive according to the invention contains other machinability enhancing substances in addition to halloysite, the content of halloysite in the machinability enhancing additive is at least 50% by weight. The machinability enhancing additive according to the present invention may contain halloysite only.

The particle size, X90, as measured according to SS-ISO 13320-1, of the halloysite comprised in machinability enhancing additive according to the invention may be below 50 μm, preferably below 40 μm, more preferably below 30 μm, more preferably below 20 μm, such as below 15 μm or below 10 μm. Alternatively, or in addition, the mean particle size, X50, may be below 25 μm, preferably below 20 μm, more preferably below 15 μm, more preferably below 10 μm, such as below 8 μm or below 5 μm. However, the particle size is more than 0.1 μm, preferably more than 0.5 μm, or more preferably above 1 μm i.e. at least 90% by weight of the particles may be more than 0.5 μm or more than 1 μm. If the particle size is below 0.5 μm, it may be difficult to mix the additive with other iron-based powder compositions to obtain a homogeneous powder mixture. Too fine particle size will also negatively influence sintered properties such as mechanical strength and dimensional changes. A particle size above 50 μm may also negatively influence the machinability enhancing performance and mechanical properties.

Thus, examples of preferred particle size distributions of the halloysite, contained in the machinability enhancing additive according to the present invention, are:

X90 below 50 μm, X50 below 25 μm and at least 90% by weight above 0.1 μm, or,

X90 below 30 μm, X50 below 15 μm and at least 90% by weight above 0.1 μm, or,

X90 below 20 μm, X50 below 10 μm and at least 90% by weight above 0.5 μm, or.

X90 below 10 μm, X50 below 5 μm and at least 90% by weight above 0.5 μm.

Other examples of preferred particle size distributions are:

X90 below 50 μm, X50 below 25 μm and at least 90% by weight above 0.5 μm, or,

X90 below 30 μm, X50 below 15 μm and at least 90% by weight above 0.5 μm, or,

X90 below 20 μm, X50 below 10 μm and at least 90% by weight above 1 μm, or.

X90 below 10 μm, X50 below 5 μm and at least 90% by weight above 1 μm.

Iron Based Powder Composition (Second Aspect)

The amount of machinability enhancing additive in the iron-based powder composition may be between 0.01% and 1.0% by weight, preferably between 0.01% and 0.5%, preferably between 0.05% and 0.4%, preferably between 0.05% and 0.3% and more preferably between 0.1% and 0.3% by weight. Lower amounts may not give the intended effect on machinability and higher amounts may have a negative influence on mechanical properties.

The machinability enhancing additive according to the invention can be used in essentially any ferrous powder compositions. Thus the iron-based powder, comprised in the iron-based powder composition, may be a pure iron powder such as atomized iron powder, reduced iron powder, and the like. Also pre-alloyed powders such as low alloyed steel powder and stainless steel powder including alloying elements such as Ni, Mo, Cr, Si, V, Co, Mn, Cu, may be used, as well as partially alloyed steel powder where the alloying elements is diffusion bonded to the surface of the iron based powder. The iron-based powder composition may also contain alloying elements in powder form, i.e. a powder or powders containing alloying element(s) are present in the iron based powder composition as discrete particles.

The machinability enhancing additive is present in the composition in powder form. The machinability enhancing additive powder particles may be mixed with the iron-based powder composition as free powder particles or be bound to the iron-based powder particles e.g. by means of a binding agent.

In order not to negatively influence the mechanical properties of a compacted and sintered part made from the iron based powder composition according to the present invention, the amount of machinability enhancing additive must be low enough not to markedly obstruct sintering between the metal particles. This means that in case of that the machinability enhancing additive powder particles are bound to the surfaces of the iron- or iron-based powder particles, the machinability enhancing additive will be present as individual discrete particles and not as a coherent coating on the iron- or iron-based particles.

The maximum content of the machinability enhancing additive is therefore 1% by weight, preferably 0.5% by weight, preferably 0.4% by weight, preferably 0.3% by weight of the iron-based powder composition.

The iron based powder composition according to the invention may also include other additives such as graphite, binders and lubricants and other conventional machinability enhancing additive. Lubricant may be added at 0.05-2% by weight, preferably 0.1-1% by weight. Graphite may be added at 0.05-2% by weight, preferably 0.1-1% by weight.

In one embodiment of the second aspect the iron-based powder composition contains or consists of a plain iron powder at a content of at least 90% by weight of the iron-based powder composition, the plain iron powder having a content of iron of at least 99 weight %, graphite at a content of 0.1-1% by weight, a lubricant at a content of 0.1-1% by weight, optionally 0.2% to 5% copper powder by weight, optionally 0.2% to 4% nickel powder by weight, and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of iron-based powder composition.

In another embodiment of the second aspect the iron-based powder composition contains or consists of plain iron powder at a content of at least 92% by weight of the iron-based powder composition, the plain iron powder having a content of iron of at least 99 weight %, graphite at a content of 0.1-1% by weight, a lubricant at a content of 0.1-1% by weight, copper powder at a content between 0.2 to 5% by weight and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of iron-based powder composition.

In another embodiment of the second aspect the iron-based powder composition contains or consists of plain iron powder at a content of at least 93% by weight of the iron-based powder composition, the plain iron powder having a content of iron of at least 99 weight %, graphite at a content of 0.1-1% by weight, a lubricant at a content of 0.1-1% by weight, nickel powder at a content between 0.2 to 4% by weight and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of iron-based powder composition.

In another embodiment of the second aspect the iron-based powder composition contains or consists of plain iron powder at a content of at least 90% by weight of the iron-based powder composition, the plain iron powder having a content of iron of at least 99 weight %, ferrophosphorous powder at a content corresponding to 0.1-2% phosphorous by weight, preferably 0.1-1% phosphorous by weight of the iron-based powder composition, optionally graphite at a content of up to 1% by weight, a lubricant at a content of 0.1-1% by weight and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of iron-based powder composition.

In another embodiment of the second aspect the iron-based powder composition contains or consists of a pre-alloyed or diffusion-alloyed iron powder at a content of at least 90% by weight of the iron-based powder composition, the pre-alloyed or diffusion-alloyed iron-based powder having a content of iron of at least 90 weight % and further contains alloying elements up to a content of 10% by weight, graphite at a content of 0.1-1% by weight, a lubricant at a content of 0.1-1% by weight and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of the iron-based powder composition. Optionally copper powder up to 4% by weight and/or nickel powder up to 4% by weight may also be contained in the iron-based powder composition.

In still another embodiment of the second aspect the iron-based powder composition contains or consists of a stainless steel powder at a content of at least 90% by weight of the iron-based powder composition, the stainless steel powder having a content of iron of at least 50 weight % and further contains alloying elements, including Si and Cr and optionally Ni, Mo and Nb, up to a total content of 45% by weight, optionally graphite at a content of up to 1% by weight, a lubricant at a content of 0.1-1% by weight and the machinability enhancing additive according to the first aspect at a content of 0.01% and 1.0% by weight, preferably between 0.01% and 0.5%, preferably between 0.05% and 0.4%, preferably between 0.05% and 0.3% and more preferably between 0.1% and 0.3% by weight of the iron-based powder composition.

Process (Fourth and Fifth Aspects)

The powder-metallurgical manufacture of components according to the invention may be performed in a conventional manner, i.e. by the following process: iron-based powder, e.g. the iron or steel powder, may be admixed with any desired alloying elements, such as nickel, copper, molybdenum and optionally carbon as well as the machinability enhancing additive according to the invention. The alloying elements may also be added as prealloyed or diffusion alloyed to the iron based powder or as a combination between admixed alloying elements, diffusion alloyed powder or prealloyed powder. This powder mixture may be admixed with a conventional lubricant, for instance zinc stearate or amide wax, prior to compacting. Finer particles in the mix may be bonded to the iron based powder by means of a binding substance for minimizing segregation and improving flowability of the powder mixture. The powder mixture may thereafter be compacted in a press tool yielding what is known as a green body of close to final geometry. Compacting generally takes place at a pressure of 400-1200 MPa. After compacting, the compact may be sintered at a temperature of 700-1350° C. and then cooled at a rate of 0.01-5° C./s in order to achieve its final strength, hardness, elongation etc. Optionally, the sintered part may be further heat-treated to achieve desired microstructures.

Sintered Component (Sixth Aspect)

The sintered component will contain all substances present in the iron-based powder composition except for organic lubricants which decompose and disappear during the sintering process. Since the content of lubricants in the iron-based powder composition is only at most 1% by weight, it is here assumed that the content of alloying elements, machinability enhancing agents etc., will practically be the same in the sintered component as in iron-based powder composition. The percentage below is in weight percentage of the sintered component. Beside the explicitly mentioned elements, the sintered components contains inevitable impurities not more than 1% by weight, preferably not more than 0.5% by weight.

In one embodiment of the sixth aspect the sintered component contains or consists of at least 90% Fe, 0.1-1% C, optionally 0.2% to 5% Cu, optionally 0.2% to 4% Ni, and optionally other alloying elements such as Mo, Cr, Si, V, Co, Mn, and the machinability enhancing additive according to the first aspect at a content of 0.01% to 1.0%, preferably 0.01% to 0.5%, preferably 0.05% to 0.4%, preferably 0.05% to 0.3%, preferably 0.1% to 0.3% by weight of iron-based powder composition.

In one embodiment of the sixth aspect the sintered component contains or consists of at least 92% Fe, 0.1-1% C, 0.2 to 5% Cu, and the machinability enhancing additive according to the first aspect at a content of 0.01% to 1.0%, preferably 0.01% to 0.5%, preferably 0.05% to 0.4%, preferably 0.05% to 0.3%, preferably 0.1% to 0.3% by weight of sintered component.

In one embodiment of the sixth aspect the sintered component contains or consists of at least 93% Fe, 0.1-1% C, 0.2 to 4% Ni, and the machinability enhancing additive according to the first aspect at a content of 0.01% to 1.0%, preferably 0.01% to 0.5%, preferably 0.05% to 0.4%, preferably 0.05% to 0.3%, preferably 0.1% to 0.3% by weight of sintered component.

In one embodiment of the sixth aspect the sintered component contains or consists of at least 96% Fe, optionally carbon up to 1%, phosphorous between 0.1% and 2%, preferably between 0.1% and 1% and the machinability enhancing additive according to the first aspect at a content of 0.01% to 1.0%, preferably 0.01% to 0.5%, preferably 0.05% to 0.4%, preferably 0.05% to 0.3%, preferably 0.1% to 0.3% by weight of the sintered component.

In one embodiment of the sixth aspect the sintered component contains or consists of at least 50% Fe, optionally up to 1% C, other alloying elements, at least including Si and Cr, up to 45% by weight and the machinability enhancing additive according to the first aspect at a content of 0.01% to 1.0%, preferably 0.01% to 0.5%, preferably 0.05% to 0.4%, preferably 0.05% to 0.3%, preferably 0.1% to 0.3% by weight of sintered component.

EXAMPLES

The present invention will be illustrated in the following non-limiting examples:

Machinability Enhancing Additive

The new machinability enhancing additive, Halloysite, originating from two different sources, were tested and compared with common silicate minerals that were known as machinability enhancing additive according to the following table 1. The major chemical compositions were determined by common X-ray powder diffraction (XRPD) analysis. The SSA (specific surface area) was measured by a BET method according to the ISO 9277:2010 and the moisture content was determined by weight-loss measurement of the material after drying 5 g powder at 230° C. for 30 min in air. Particle size was determined with laser diffraction according to ISO 13320:1999.

TABLE 1

| | silicate minerals | $SiO_2$, % | $Al_2O_3$, % | MgO, % | X50, μm | X90, μm | SSA, $m^2/g$ | Moisture, % |
|---|---|---|---|---|---|---|---|---|
| According to invention | Halloysite A | 46.3 | 38.2 | <0.1 | 3.8 | 10.2 | 54.3 | 3.55 |
| According to invention | Halloysite B | 49.5 | 35.5 | 0.02 | 3.5 | 24.6 | 27.9 | 2.66 |
| Comparative example | Kaolinite | 45.0 | 38.5 | 0.1 | 3.3 | 23.9 | 12.7 | 0.64 |

TABLE 1-continued

| | silicate minerals | $SiO_2$, % | $Al_2O_3$, % | MgO, % | X50, μm | X90, μm | SSA, $m^2/g$ | Moisture, % |
|---|---|---|---|---|---|---|---|---|
| Comparative example | Mica | 42.9 | 12.1 | 28.8 | 2.9 | 31.1 | 4.3 | 0.40 |
| Comparative example | Talc | 61.0 | 0.2 | 30.5 | 4.3 | 10.8 | 15.8 | 0.32 |

All materials in table 1 exhibit similar mean particle size, X50. For X90, (it means 90% of the particles by weight has a particle size below the value), halloysite A is smaller than the halloysite B; while the particle size of halloysite B is similar to that of kaolinite and mica; the particle size of halloysite A is similar to that of talc. Both of halloysite materials have similar chemical compositions to the kaolinite but they are different from the other silicate minerals such as mica and talc which contain large amount of magnesium oxide (MgO). As expected, the halloysite materials contain much higher percentage of moisture than all of other silicate materials. The moisture is contributed from the interlayer water presented in its chemical compositions. For fully hydrated halloysite, it contains 12.2% $H_2O$ according to a calculation based on the chemical formula. Therefore, the halloysite materials listed in table 1 were partially dehydrated, i.e. approximately 25% $H_2O$ still remains in the structure.

Six (6) powder metallurgical compositions were prepared as shown in table 2. Each mix contained the pure atomized iron powder ASC100.29 available from Höganäs AB, Sweden, 2% by weight of a copper powder Cu165 available from ACuPowder, USA, 0.85% by weight of a graphite powder Gr1651 available from Asbury Graphite, USA, and 0.75% by weight of a lubricant, Acrawax C available from Lonza, USA. Mix No 1 and 2 contained 0.3% by weight of a machinability enhancing additive according to the invention and mix No 3 to 5 contained 0.3% by weight of the known machinability enhancing additive. Mix No 6 was used as reference and did not contain any machinability enhancing substance.

TABLE 2

| mix no. | description | silicate mineral | addition, % |
|---|---|---|---|
| 1 | According to invention | Halloysite A | 0.3 |
| 2 | According to invention | Halloysite B | 0.3 |
| 3 | Comparative example | Kaolinite | 0.3 |
| 4 | Comparative example | Mica | 0.3 |
| 5 | Comparative example | Talc | 0.3 |
| 6 | Reference | none | 0 |

The mixes were compacted into green samples in a shape of rings, height=20 mm, inner diameter=35 mm, outer diameter=55 mm, by uniaxial pressing to a green density of 6.9 $g/cm^3$ followed by sintering at 1120° C. in an atmosphere of 90% nitrogen/10% hydrogen for a period of time of 30 minutes. After cooling to ambient temperature the samples were used for machinability tests.

Also transverse rupture strength test samples according to ISO 3325 were produced by uniaxial compaction of the powder metallurgical compositions to a green density of 6.9 $g/cm^3$, followed by sintering at 1120° C. in an atmosphere of 90% nitrogen/10% hydrogen for a period of time of 30 minutes. After cooling to ambient temperature the samples were used for test of transverse rupture strength (TRS) according to ISO 3325.

The machinability of the sintered samples was evaluated with drilling and turning operations respectively.

For drilling, ⅛ inch plain (uncoated) high speed steel drill bits were used to drill blind holes with a depth of 18 mm in wet conditions, i.e. with coolant. The machinability of materials made from each mix was evaluated with respect to the number of holes drilled before drill failure, e.g. excessive worn or breakage in the cutting tool. Two tests, drilling test 1 and drilling test 2, were respectively performed at different feed rate of 0.075 mm per revolution and 0.13 mm per revolution. Maximum 36 holes per ring sample were drilled.

For turning, TiCN coated carbide inserts were used to cut the inner diameter (ID) of ring samples in wet condition, i.e. with coolant. The turning parameters were: speed 275 mm/min, feed 0.1 mm/rev, depth 0.5 mm, length 20 mm/cut. Maximum 30 cuts per ring sample were made. The tool wear was evaluated respectively at 90 cuts (turning 1) and 180 cuts (turning 2). Excessive tool wear is considered when the tool wear (flank wear) is more than 200 μm.

The following table 3 shows the results from the machinability tests and TRS test.

TABLE 3

| mix no. | description | silicate mineral | drilling (1), no. of holes | drilling (2), no. of holes | turning (1) tool wear, μm | turning (2) tool wear, μm | TRS [MPa] |
|---|---|---|---|---|---|---|---|
| 1 | According to invention | Halloysite A | 180* | 72* | 75 | 103 | 1007 |
| 2 | According to invention | Halloysite B | 180* | 72* | 90 | 117 | 972 |
| 3 | Comparative example | Kaolinite | 30 | 13 | 136 | 530 | 986 |
| 4 | Comparative example | Mica | 3 | 4 | 75 | 226 | 938 |
| 5 | Comparative example | Talc | 1 | 2 | 100 | 208 | 952 |
| 6 | Reference | none | 3 | 3 | 554 | >554 | 1027 |

*the test was terminated without tool broke

For the tests with mix 1 and mix 2 according to the invention, drilling 1 and drilling 2 were stopped after 180 and 72 holes respectively without notice of any drill failure.

None of the known machinability enhancing agents, except for kaolinite which gave some improvement, show any improvement at drilling compared to the reference example without any machinability enhancing additive added.

For turning, both of the machinability enhancing additive according to the invention and the known machinability enhancing substances reduce the tool wear considerably after 90 cuts (turning 1) compared to the reference example without machinability enhancing additive. However, excessive tool wear were observed with the known machinability enhancing agents used in mix 3, 4, 5 after 180 cuts (turning 2) while the mixes with the machinability enhancing additive according to the invention, mix 1 and mix 2, were still presenting good performance in improving the machinability for turning.

The TRS-tests shows that addition of halloysite has less impact on TRS compared to mica and talc.

From table 3 it is evident that halloysite as machinability enhancing additive presents excellent results in both drilling and turning.

The invention claimed is:

1. A powder composition comprising an iron-based powder and between 0.01% and 1.0% by weight of the iron-based powder of a machinability enhancing additive, said machinability enhancing additive comprising halloysite and, optionally, at least one other machinability enhancing additive, wherein the halloysite is at least 50% by weight of the machinability enhancing additive, wherein the iron-based powder is either a pre-alloyed iron powder or a partially alloyed iron powder containing 50 wt % to 96 wt % iron and at least one alloying element.

2. The powder composition according to claim 1, wherein the machinability enhancing additive consists of halloysite.

3. The powder composition according to claim 1, wherein the halloysite is a powder having a particle size distribution of X90 below 20 μm, X50 below 10 μm and at least 90% by weight is above 1 μm measured according to SS-ISO 13320-1.

4. The powder composition according to claim 1, wherein the halloysite is a powder having a particle size distribution of 90% by weight below 10 μm, 50% by weight below 5 μm and at least 90% by weight above 0.5 μm measured according to SS-ISO 13320-1.

5. The powder composition according to claim 1, wherein the specific surface area of the halloysite is at least 15 $m^2/g$ measured by a BET method according to the ISO 10 9277:2010.

6. The powder composition according to claim 1, comprising at least 90% by weight iron-based powder.

7. The powder composition according to claim 6, further comprising graphite at a content of 0.1-1% by weight, and copper powder at a content between 0.2 to 5% by weight.

8. The powder composition according to claim 6, further comprising nickel powder at a content between 0.2 to 4% by weight.

9. The powder composition according to claim 6, further comprising ferrophosphorous powder at a content corresponding to 0.1-2% phosphorous by weight.

10. The powder composition of claim 1, wherein the powder composition is configured to be sintered at a temperature of 700-1350° C.

11. The powder composition according to claim 1, wherein the halloysite is partially dehydrated halloysite.

12. The powder composition according to claim 1, wherein the halloysite is a powder having a particle size distribution of X90 below 30 μm, X50 below 15 μm and at least 90% by weight above 0.1 μm measured according to SS-ISO 13320-1.

13. The powder composition according to claim 1, wherein the powder composition is prepared by admixing the iron-based powder with alloying elements and optionally carbon, and the machinability enhancing additive to arrive at a powder composition where the machinability enhancing additive is present in the admixture as free powder particles or where the machinability enhancing additive is bound to surfaces of particles of the iron-based powder and is present as individual discrete particles and not as a coherent coating on the particles of the iron-based powder.

14. The powder composition according to claim 1, wherein the iron-based powder contains 50 wt % to 90 wt % iron.

15. The powder composition according to claim 1, wherein the iron-based powder contains 90 wt % to 96 wt % iron.

16. The powder composition according to claim 1, wherein the at least one alloying element is selected from the group consisting of Mo, Ni, Cu, Cr, Mn, Si, C, V, Co and combinations thereof.

17. A composition consisting of the powder composition of claim 1 and at least one lubricant.

18. The composition of claim 17, wherein the lubricant is 0.05-2% by weight of the composition.

19. The composition of claim 17, wherein the lubricant is zinc stearate or amide wax.

* * * * *